United States Patent [19]

Pettit

[11] Patent Number: 4,623,126

[45] Date of Patent: Nov. 18, 1986

[54] PERIMETER FENCE FOR ABOVE-GROUND SWIMMING POOLS

[76] Inventor: Frederick M. Pettit, 1411 Point Abino Road S., Ridgeway, Ontario, Canada, L0S 1N0

[21] Appl. No.: 562,414

[22] Filed: Dec. 16, 1983

[51] Int. Cl.[4] ..... E04H 17/18

[52] U.S. Cl. ..... 256/25; 256/65; 4/496

[58] Field of Search ..... 256/24, 25, 1, 31, 65, 256/67, 64, 59; 4/506, 494, 504, 496, 488

[56] References Cited

U.S. PATENT DOCUMENTS

| | | | |
|---|---|---|---|
| 2,835,475 | 5/1958 | Enghauser | 256/24 |
| 3,076,636 | 2/1963 | Blum | 256/67 |
| 3,648,301 | 3/1972 | Wiley | 4/506 |
| 3,840,908 | 10/1974 | Greene | 4/506 |
| 3,877,085 | 4/1975 | Bukaitz et al. | 4/488 |
| 4,193,229 | 3/1980 | Hartman | 256/67 |
| 4,225,120 | 9/1980 | McLaughlin | 256/65 |
| 4,303,226 | 12/1981 | Powell et al. | 256/25 |
| 4,474,168 | 10/1984 | Pettit | 4/493 |

*Primary Examiner*—Cornelius J. Husar
*Assistant Examiner*—Peter M. Cuomo
*Attorney, Agent, or Firm*—Christel, Bean & Linihan

[57] ABSTRACT

A universal perimeter fence (16) for an above-ground pool. The perimeter fence consists of a plurality of three different assemblies which are fence post assemblies (18), rail assemblies (20) and mounting assemblies which include bottom post connectors (22) and top post connectors (24). The angles of the posts can be varied relative to the pools to accommodate for differing overhangs of top rails (14) and the rail assemblies are field cut the accommodate for differing spacings between the pool wall supports (12) as well as differing angles. Each of the post assemblies (18) include rail connectors (30) which have outwardly extending tubular portions (36), the inner and outer faces (80,76) being at differing angles to provide for differing diameter pools.

7 Claims, 8 Drawing Figures

Fig. 1.
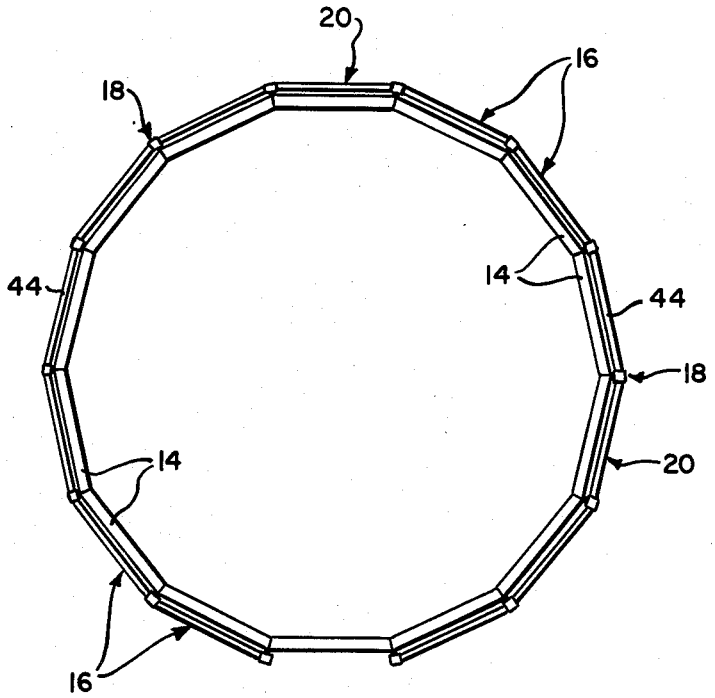
Fig. 3.
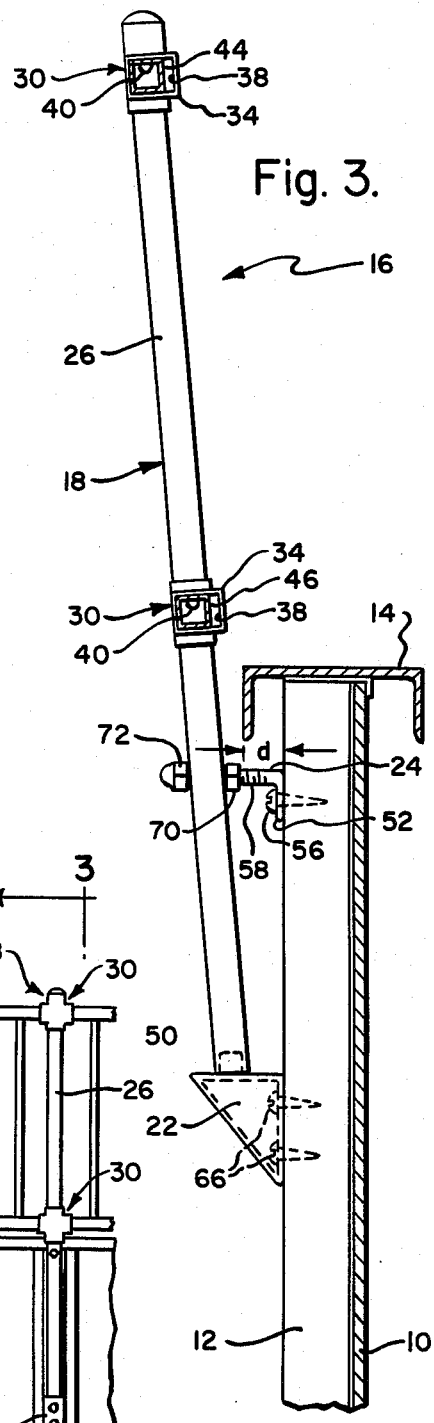
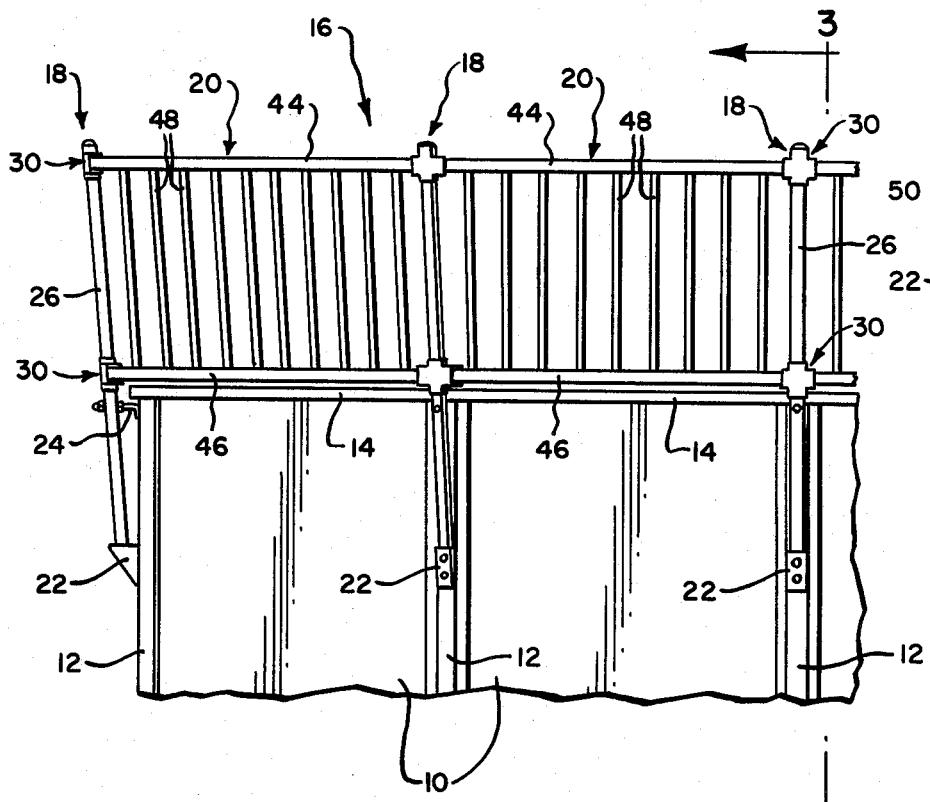
Fig. 2.

Fig. 4.
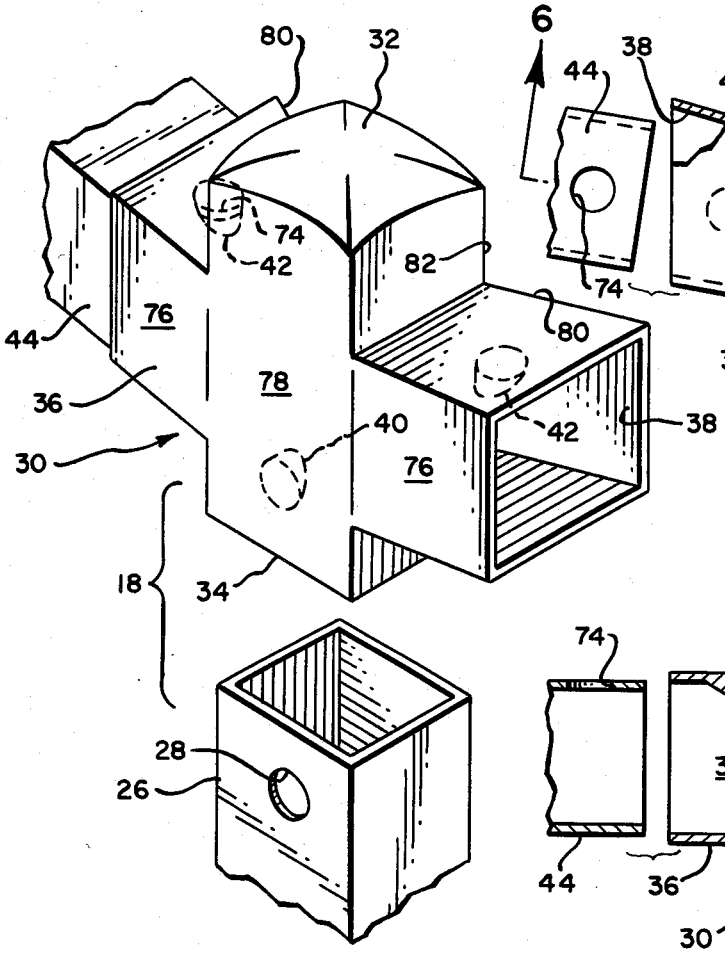
Fig. 5.
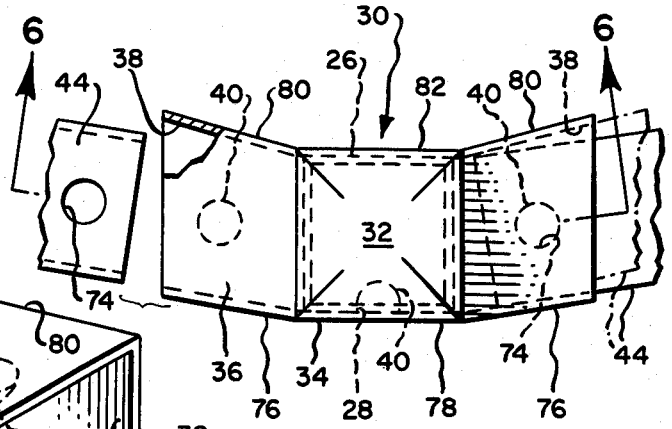
Fig. 6.
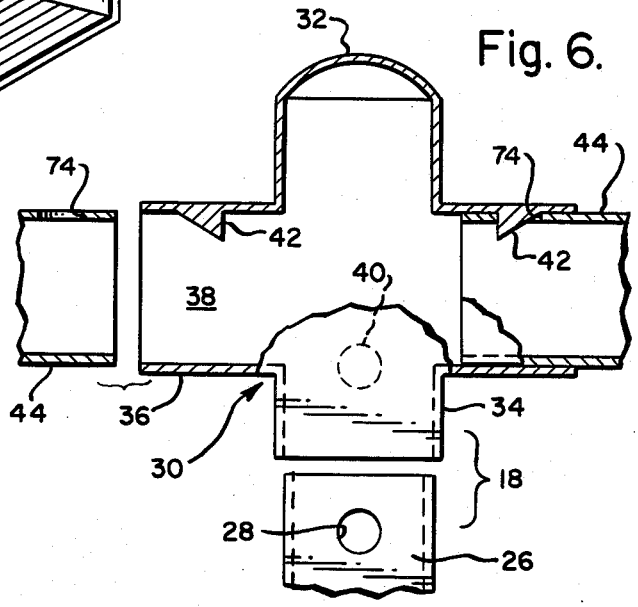
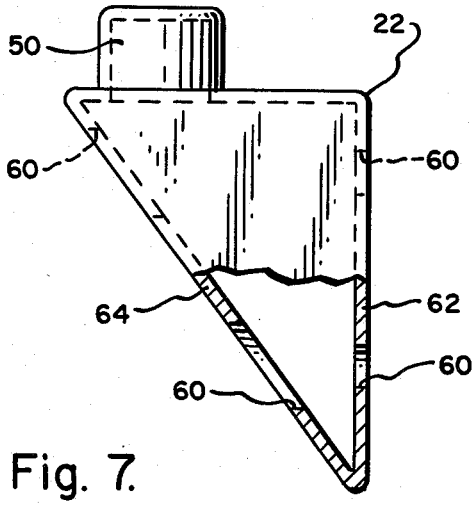
Fig. 7.
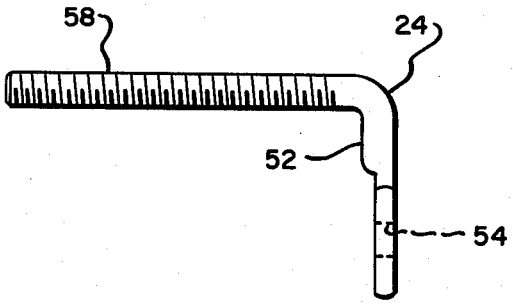
Fig. 8.

PERIMETER FENCE FOR ABOVE-GROUND SWIMMING POOLS

FIELD OF THE INVENTION

The present invention relates generally to perimeter fences for above-ground swimming pools, and more particularly to a universal fence construction which can be secured to a wide variety of swimming pools of the type having pool walls supported by a plurality of spaced-apart vertical pool wall supports.

BACKGROUND OF THE INVENTION

Prior to this invention a large number of above-ground swimming pools have been installed in various locations. The form of pool with which this invention is adapted to be associated generally has pool walls of approximately 4 feet (122 cms.) in height. These walls are supported by a plurality of vertical pool wall supports which are customarily spaced 4 to 4½ feet apart (122 to 137 cms.). Customarily, a top rail is disposed over the tops of the vertical pool wall supports and the pool walls. The pool sizes may vary from 15 feet (4.57 meters) to 27 feet (8.23 meters) in diameter. These pools can be circular, oval, and even rectangular. While many of these pools have been erected in fenced yards, many were not. In any event, many municipalities now require that such pools be fenced by a 6 foot (1.83 meter) or even 7 foot (2.13 meter) fence. If a prior fence does not meet this height requirement, or if no fence existed at all, the owner of the pool may be required to erect such a fence either about his yard or about the perimeter of the pool. A pool perimeter fence obviously can be either supported by the ground or alternatively, and much more practically, be supported by the pool itself. Such pool perimeter fences customarily meet the various municipal ordinances.

As the distance between the vertical pool wall supports vary, as noted above, it has been in the past difficult to provide a retrofit perimeter fence design which is adaptable to all pools. Thus, it would be necessary to provide a wide variety of differing lengths of fence rails to accommodate for the different spacings. In addition, because the top rail of the pool will vary in width, and particularly in the amount it overhangs to the exterior of the pool, it is also difficult to provide fence post connectors which would accommodate for varying top rail widths.

In one prior art perimeter above-ground swimming pool fence design, which was adapted to be secured to the vertical pool wall supports, each fence post was supported by bottom and top post connectors. The bottom post connector was secured to the vertical pool wall support approximately 42 cms. below the top rail, which bottom post connector permitted movement of the fence post towards and away from the top rail. The top post connector was an angle bracket provided with an aperture which received the fence post, and this bracket was moved up and down the post to a desired location to establish the proper angle of the post with respect to the top rail and was then strung between the various fence posts. While this design met the municipal codes, it was unsatisfactory in a number of differing respects. Thus, in pools having top rails of large width, there was insufficient distance between the bottom and top post connectors to properly support the fence post. In addition, the fence material was aesthetically unattractive and would tend to sag between the fence posts if erected with insufficient tension.

OBJECTS AND SUMMARY OF THE PRESENT INVENTION

It is an object of the present invention to provide an improved perimeter fence for above-ground swimming pools which can be retrofit to a wide variety of pools. More specifically, it is an object of the present invention to provide a perimeter fence for above-ground swimming pools of the type having spaced apart vertical pool wall supports which perimeter fence has fence posts which can be readily secured to the vertical pool wall supports, and horizontally extending fence rails which can be rapidly connected to the fence posts in a stable manner. It is another object of the present invention to provide such a perimeter fence for above-ground swimming pools wherein the fence is made of low cost, high durability, low maintenance products.

The above objects and other objects and advantages of the present invention will become more apparent from the following detailed description taken in conjunction with the accompanying drawings in which preferred forms of this invention are illustrated.

BRIEF DESCRIPTION OF THE FIGURES

FIG. 1 is a plan view of a typical above-ground pool provided with the perimeter fence of this invention.

FIG. 2 is an enlarged side elevation view of a portion of the above-ground swimming pool shown in FIG. 1.

FIG. 3 is a further enlarged view taken generally along the line 3—3 in FIG. 2.

FIG. 4 is a top exploded view, in isometric, of the top portion of a fence post and the associated top rail connector.

FIG. 5 is a transverse section of a rail connector shown associated with the corresponding rails of a rail assembly.

FIG. 6 is a section taken generally along the line 6—6 in FIG. 5.

FIGS. 7 and 8 are side views, respectively of bottom and top post connectors which are utilized to secure a fence post to a pool wall support.

DETAILED DESCRIPTION

Referring first to FIGS. 1, 2 and 3, a typical above-ground pool consists of a pool wall 10 which is supported by a plurality of spaced apart pool wall supports 12, and a top rail 14 which extends about the pool. Disposed within the pool wall is a liner which retains water within the pool. As this form of above-ground pool construction is well known in the art, it will not be described in greater detail. However, as previously noted the distance between the vertical pool wall supports 12 may vary and, in addition, the pool diameter may also vary. Furthermore, the distance which the top rail overhangs the vertical pool wall supports, which distance is indicated at d in FIG. 3 may vary from one pool to another, or from one manufacturer of pools to another.

The perimeter fence of this invention, which is indicated generally at 16, can be adapted to a wide variety of differing pool designs. The perimeter fence consists essentially of a plurality of three differing assemblies, the first being fence post assemblies indicated generally at 18, the second being rail assemblies indicated generally at 20, and the third being mounting assemblies which include bottom post connectors 22 and top post connectors 24, both being adapted to be secured to pool wall supports.

Each of the fence post assemblies, which are equal in number to the number of pool wall supports 12, consists of a tubular post 26 of rectangular cross section. The post preferably is formed of an ultraviolet stable plastic such as high density polyethylene or poly vinyl chloride. The tubular post will have openings at its lower and upper ends. In addition, each post is provided with a transversely extending aperture which can receive the top post connector, and a pair of spaced apart apertures 28 (only the top aperture 28 being shown in FIG. 4) between the transversely extending aperture and the top opening in the post. Each post assembly further includes a pair of spaced apart rail connectors indicated generally at 30. Each of the pair of spaced apart rail connectors is essentially the same although the upper rail connector is provided with a cap portion 32 which may be formed integrally therewith. The cap portion 32 will prevent water and other foreign materials from entering into the tubular post. Each of the rail connectors can be considered to be two crossed tubular members, the normally vertically extending tubular member 34 being disposable about the post to permit sliding of the rail connector vertically with respect to the tubular post 26. The transversely extending tubular member 36 provides side openings 38. Each of the tubular members 34,36 is provided with locking elements, and thus the vertical tubular member is provided with a locking element 40 and the transverse tubular member is provided with a pair of locking elements 42, one associated with each of the side openings 38. With reference to FIG. 4 it can be seen that the locking element 40 may engage the aperture 28 to position the top rail connector on the tubular fence post 26. By the same token, the lower rail connector also engages a corresponding aperture 28 to properly locate the lower rail connector with respect to the tubular post 26. The locking elements 40,42 may be of a button shape which will facilitate not only proper assembly but will also facilitate disassembly, the button shape acting as a detent to properly locate one element with respect to another. Alternatively, the locking elements can be of the shape illustrated in FIG. 6 which will insure that once the parts have been assembled they cannot readily be disassembled. The precise form of the locking element will of course depend upon the ultimate use, however, in most situations it is believed that the form in FIG. 6 will be desirable.

Each of the rail assemblies consists of an upper rail 44, a lower rail 46 and a plurality of vertical rails 48. The upper, lower and vertical rails can be formed of the same material used for forming tubular posts 26. The vertical rails can be formed of 1 inch (2.5 cm. diameter tubular material and the top and bottom rails can be formed of 1½ inch (3.81 cm. diameter tubular material. The top and bottom rails 44,46 may be provided with suitable apertures for the reception of the vertical rails 48, the ends of the rails 48 being received within the apertures and being maintained in their assembled position in any suitable manner.

The bottom post connector 22 (FIG. 7) is generally triangular in shape as can best be seen from FIG. 7 and is preferably formed of a plastic material by blow molding or the like. The bottom post connector in addition has an outwardly extending projection 50 which is adapted to have the lower open end of an associated tubular post disposed about it. In this connection, the diameter and cross-section of the projection 50 will be so sized as to correspond to that of the tubular post 26.

The top post connector (FIG. 8) consists essentially of an L-shaped element the shorter leg 52 of which is flattened and provided with an aperture 54 for the reception of a fastener such as a sheet metal screw 56 (FIG. 3). The longer portion 58 is adapted to be mounted horizontally and project radially outwardly from the pool, the longer portion 58 being threaded.

One who desires to erect a perimeter fence of this invention will purchase a number of fence post assemblies and mounting assemblies equal in number to the number of the vertical pool wall supports of the pool. He will also in addition purchase a plurality of rail assemblies, one less than the number of the vertical pool wall supports. The fence will be erected by mounting the top and bottom post connectors on associated pool wall supports. To this end, the bottom post connector is provided with suitable apertures 60 in its radial inner and outer walls 62,64, respectively, the apertures 60 in the outer wall 64 being of a sufficiently large diameter that the head of a fastener, such as a sheet metal screw, may pass therethrough, but the diameter of the apertures in the inner wall 62 being of a reduced diameter so that the head of the fastener will bear against the outer surface of the inner wall. Thus, the bottom post connectors 22 are suitably secured to the associated pool wall support 12 by fasteners 66 as indicated in FIG. 3. The top post connector will also be secured by means of fastener 56 adjacent the top rail of the pool. It is preferable that the distance between the upper surface of the bottom post connector and the top post connector be 12–15 inches (32–38 cm. in order to give adequate support to the fence. Before the tubular posts are erected it is necessary to place a stop nut 70 on the threaded portion 58 of the top post connector 24 to establish the proper angle at which the tubular posts 26 will be mounted. The tubular posts 26 are then mounted by disposing the lower end of a first post about the outwardly extending projection 50 of a bottom post connector 22 and passing the longer threaded portion 58 of an associated top post connector 24 through the transversely extending aperture in the posts until one side of the post abuts against a stop nut 70. Another nut 72, which is preferably of the locking variety, is then threaded down the portion 58 until it bears against the opposite side of the tubular post 26. The threaded portion which then extends beyond the locking nut 72 is cut off and a suitable cap is placed over the cut end of the threaded portion to prevent injury to persons who may come in contact with the fence at this location. The upper and lower rails are then cut to the proper length and holes or apertures 74 are then drilled in the end portions of each of the rails to receive an associated locking element 42. It is then necessary to partially install one pair of upper and lower rails and this is done by inserting one end of an upper and one end of a lower horizontal rail into the spaced apart rail connectors on the mounted tubular post 26 with the locking element of each of the rail connectors projecting into the associated aperture or hole 74 adjacent one end of the rails. After this has been done the next adjacent fencepost will be mounted on the associated top and bottom post connectors with the other ends of the partially installed upper and lower horizontal rails being received and locked within the rail connectors on the fence post. The various steps set forth above will then be repeated until the perimeter fence of this invention has been completely assembled.

It should be noted from an inspection of FIG. 5 that each rail connector has the transverse tubular members 36 extending away at an angle from the outside and inside faces of the vertical tubular member 34. In order to accommodate for differing diameter pools the outside faces 76 of the transverse tubular members are at an 8.5° angle with respect to the corresponding outside face 78 of the vertical tubular member 34. However, the inside faces 80 of the transverse tubular members 36 are at a 15° angle with respect to the corresponding inside face 82 of the vertical tubular member. As the wall thicknesses of the transverse tubular members 36 are relative uniform this will permit the upper and lower rails to be mounted at 8.5° to 15° angles relative to the tangent of the pool whereby pools of differing diameters of from 15 feet (4.57 m. to 27 feet (8.23 m.) can be fenced with the perimeter fence of this invention.

While a preferred structure in which the principles of the present invention have been incorporated is shown and described above, it is to be understood that this invention is not to be limited to the particular details shown and described above, but that, in fact, widely differing means may be employed in the broader aspects of this invention.

What is claimed is:

1. A method of erecting a perimeter fence for an above-ground swimming pool of the type having a pool wall, a plurality of spaced apart vertical pool wall supports, and a top rail extending between said vertical pool wall supports; said method comprising the following steps:

(a) providing a number of fence posts and mounting assemblies equal in number to the vertical pool wall supports of the pool, and also providing a plurality of rail assemblies one less than the number of vertical wall supports, each fence post being provided with an opening at one end, a pair of spaced apart outwardly extending rail connectors open to the sides, each rail connector having a locking element, and each fence post further being provided with a transversely extending aperture disposed between said one end and the pair of spaced apart outwardly extending rail connectors, each of the mounting assemblies including a bottom post connector having an outwardly extending projection and a top post connector having an elongated threaded portion, and each of the rail assemblies including upper and lower horizontal rails of a length normally greater than the distance between the fence posts when mounted upon the vertical pool wall supports;

(b) mounting the mounting assemblies on the vertical pool wall supports in vertically spaced apart relationship with the elongated threaded portion of the top post connector extending away from the pool in a horizontal direction, and the projection of the bottom post connector extending towards the top post connector;

(c) threading stop nuts onto the elongated threaded portion to establish the fence post mounting angle;

(d) mounting a first fence post with the opening in one end about the projection on a first bottom post connector and with a portion of the elongated threaded projection of a first top post connector extending through the transversely disposed aperture in said first fence post, and securing the post to said first top post connector by threading a securing nut onto the elongated threaded portion and causing it to bear against a side of the fence post;

(e) cutting the upper and lower horizontal rails to the proper length required for assembly and drilling holes through a side wall adjacent the ends thereof;

(f) inserting one end of an upper and a lower horizontal rail into the spaced apart rail connectors with the locking element of each of the rail connectors projecting into the associated hole adjacent one end of the upper and lower rails;

(g) mounting the next adjacent fence post with the opening in one end about the projection on the next adjacent bottom post connector and with a portion of the elongated threaded projection of the next adjacent top post connector extending through the horizontal aperture in the fence post and with the ends of the upper and lower horizontal rails being received and locked within the rail connectors, the fence post being held in its assembled position by means of a securing nut threaded about the elongated threaded projection and bearing against one side of the next adjacent fence post; and (h) repeating steps (f) through (g) until the entire fence is erected.

2. The method of erecting a fence as set forth in claim 1 further characterized by the additional step of cutting off that portion of the elongated threaded portion which extends outwardly of each fence post after it has been erected and covering the cut end of the elongated threaded portion.

3. A perimeter fence for an above-ground swimming pool of the type having a pool wall, a plurality of spaced-apart pool wall supports, and a top rail extending between said vertical pool wall supports, said perimeter fence comprising:

a number of fence post assemblies and mounting assemblies equal in number to the number of vertical pool wall supports of the pool and also a plurality of rail assemblies, one less than the number of vertical pool wall supports; each fence post assembly including a tubular post having an opening at one end, and a transversely extending aperture, and a pair of spaced apart outwardly extending rail connectors, each having tubular side openings; each of the mounting assemblies including a bottom post connector having an outwardly extending tubular projection receivable within the opening at one end of the tubular post, the bottom post connector being adapted to be secured to an associated vertical pool wall support in such a manner that the outwardly extending tubular projection extends in an upward direction, and an L-shaped top post connector having an elongated threaded leg and a shorter apertured leg which is adapted to be secured to an associated wall support in such a manner that the elongated threaded leg extends horizontally away from the pool, and each of the rail assemblies including upper and lower horizontal rails and a plurality of interconnecting vertical rails, the upper and lower rails being receivable within the tubular side openings.

4. The perimeter fence as set forth in claim 3 wherein each of the posts is provided with spaced apart apertures in the sidewalls thereof, and wherein each of the rail connectors is slidable about said post and is provided with an integral locking element in the form of a detent engageable with one of the holes in the post to locate said rail connector.

5. In combination with an above-ground swimming pool of the type having a pool wall, a plurality of spaced-apart vertical pool wall supports, and a top rail extending between said vertical pool wall supports, a perimeter fence comprising:

a plurality of mounting assemblies equal in number to the vertical pool wall supports of the pool, each of the mounting assemblies including a bottom post connector secured to an associated vertical pool wall support between the ends thereof, the bottom post connector having an upwardly extending projection, and each of the mounting assemblies further including a top post connector secured to the vertical pool wall support adjacent the top thereof, said top post connector having an elongated threaded portion which extends away from the pool in a horizontal direction;

a plurality of fence post assemblies equal in number to the vertical pool wall supports, each fence post assembly including a tubular post having a opening in its lowermost end which receives the upwardly extending projection of the bottom post connector, and a transverse aperture which receives the elongated threaded portion, each of said posts being secured to the elongated threaded portion by a pair of nuts contacting the inner and outer sides of said posts, and each post assembly further including a pair of spaced apart rail connectors, each having transversely extending tubular side openings, each of said pair of rail connectors being mounted on an associated post in spaced apart locations; and a plurality of rail assemblies, each rail assembly including upper and lower horizontal rails received within said tubular side openings of the rail connectors, the rail assemblies further including vertical rails.

6. The perimeter fence as set forth in claim 5 wherein each of the posts is provided with spaced apart apertures in the sidewalls thereof, and wherein each of the rail connectors is slidably about said post and is provided with an integral locking element in the form of a detent which is engaged with one of the holes in the post to locate said rail connector.

7. The perimeter fence as set forth in claim 5 wherein the inside and outside faces of the tubular side openings are disposed at differing angles.

* * * * *